US005199895A

United States Patent [19]

Chang

[11] Patent Number: 5,199,895

[45] Date of Patent: Apr. 6, 1993

[54] LOW INSERTION FORCE, SELF-LOCKING CONNECTING APPARATUS FOR ELECTRICALLY CONNECTING MEMORY MODULES TO A PRINTED CIRCUIT BOARD

[76] Inventor: Lien-Ker Chang, No. 20, Lane 17, Sec. 1, Yung An N., Taipei Hsien, Taiwan

[21] Appl. No.: 830,907

[22] Filed: Feb. 4, 1992

[51] Int. Cl.[5] ..... H01R 23/70

[52] U.S. Cl. ..... 439/326; 439/636

[58] Field of Search ..... 439/326–328, 439/630–637

[56] References Cited

U.S. PATENT DOCUMENTS

| | | | |
|---|---|---|---|
| 4,737,120 | 4/1988 | Grabbe et al. | 439/328 |
| 4,850,892 | 7/1989 | Clayton et al. . | |
| 4,984,996 | 1/1991 | Watanabe et al. | 439/326 |
| 5,041,005 | 8/1991 | McHugh | 439/326 |
| 5,085,593 | 2/1992 | Iuan | 439/326 |
| 5,100,338 | 3/1992 | Lu | 439/326 |

*Primary Examiner*—David L. Pirlot

[57] ABSTRACT

A edge connector socket for printed circuit boards comprises an elongate insulative housing having a channeled receiving space extending between respective end portions thereof, and a plurality of conductive contact members disposed on corresponding slots formed perpendicularly along the receiving space. Each end portion has a vertical post with a protruding pin on a first side of the housing and an inclined ramp for guiding the insertion of a daughterboard on a second side of the housing. Each contact member has a resilient spring appendage and a fulcrum appendage formed spacedly thereon so as to define a receiving space for an inserted edge portion of a daughterboard. The spring appendages deflect upon the insertion of a daughterboard and apply a torque thereon so as to rotate the board about a pivot axis defined by the fulcrum appendages in contact with an opposing side thereon. The board is rotated towards the vertical posts upon release so as to engage the pins thereon with cooperating apertures on the board to secure the board in a functional position on the socket.

3 Claims, 6 Drawing Sheets

LOW INSERTION FORCE, SELF-LOCKING CONNECTING APPARATUS FOR ELECTRICALLY CONNECTING MEMORY MODULES TO A PRINTED CIRCUIT BOARD

BACKGROUND OF THE PRESENT INVENTION

The present invention relates to an edge connector socket for printed circuit boards, and more particularly to an edge connector socket for printed circuit boards which can automatically rotate an inserted daughterboard into a functional position thereon without need of manual assistance and sans the resilient latch members found on the socket housings of more conventional printed circuit board sockets.

Referring to FIG. 1 of the drawings, a structure of an edge connector socket for printed circuit boards typical of a generic type comprises an elongate housing 1 having a recessed channel 1*a* extending therealong between respective end portions, and a plurality of contact members 5 disposed within corresponding slots 1*b* formed perpendicularly over the channel.

A daughterboard 3 is secured in a functional position within the socket by first inserting a cooperating edge portion of the board into channel 1*a* at a predetermined acute angle so as to be received within the contact members 5. The board is then manually rotated towards a vertical post 6 on each end portion of the housing so as to engage protruding pins 61 thereon with cooperating apertures 30 on the daughterboard. In the course of rotation, the lateral edges of board 3 engage protruding catches 41 on respective resilient latch members 4 provided on either end portion of the housing to effect their flexure. The subsequent recovery of the latches brings the catches 41 into abutment with an opposing side of the board to secure it's position on the socket. Conversely, removal of the daughterboard requires that the latches be manually deflected prior to the rotation and extraction of the board from the housing.

The edge connector socket of the present invention provides for an automatic rotation of an inserted daughterboard into a functional position thereon which does not require manual assistance, and which lacks ancillary latch members, so as to facilitate and expedite the mounting or removal of a board thereon.

SUMMARY OF THE PRESENT INVENTION

An edge connector socket for a printed circuit board in accordance with the present invention comprises an elongate insulative housing having a recessed channel for the insertion of a daughterboard, and a plurality of conductive contact members having resilient appendages provided thereon. Each contact member is disposed within a corresponding slot formed along the housing over the channel. A daughterboard is inserted into the housing at a predetermined angle with the aid of a pair of inclined guide ramps provided on respective end portions of the housing. Wherein, a terminal edge of the board engages a cam surface on a spring appendage of the contact members to effect it's compression and generate a reaction force against one side of the board. The force subsequently acts as a torque which rotates the board upon it's release about a pivot axis defined by a fulcrum appendage of the contact members in abutment with an opposing side of the board. The board contacts a vertical post on each end portion of the housing when rotated into a vertical, functional position on the socket, with corresponding apertures thereon engaging cooperating securing pins on the upper ends of the posts to secure the board in place.

It is thus a main object of the present invention to provide an edge connector for a printed circuit board as characterized that automatically brings an inserted circuit board into a secured functional position therein without need of manual rotation.

A further object of the present invention is to provide an edge connector for printed circuit boards that does not require resilient latch members provided either unitarily or separately on it's housing, as in more conventional connectors.

Other and more particular objects of the present invention will become readily apparent after referring to a detailed description of a preferred embodiment thereof provided below along with accompanying drawings.

DETAILED DESCRIPTION OF THE PREFERRED EMBODIMENT

Figure 1:
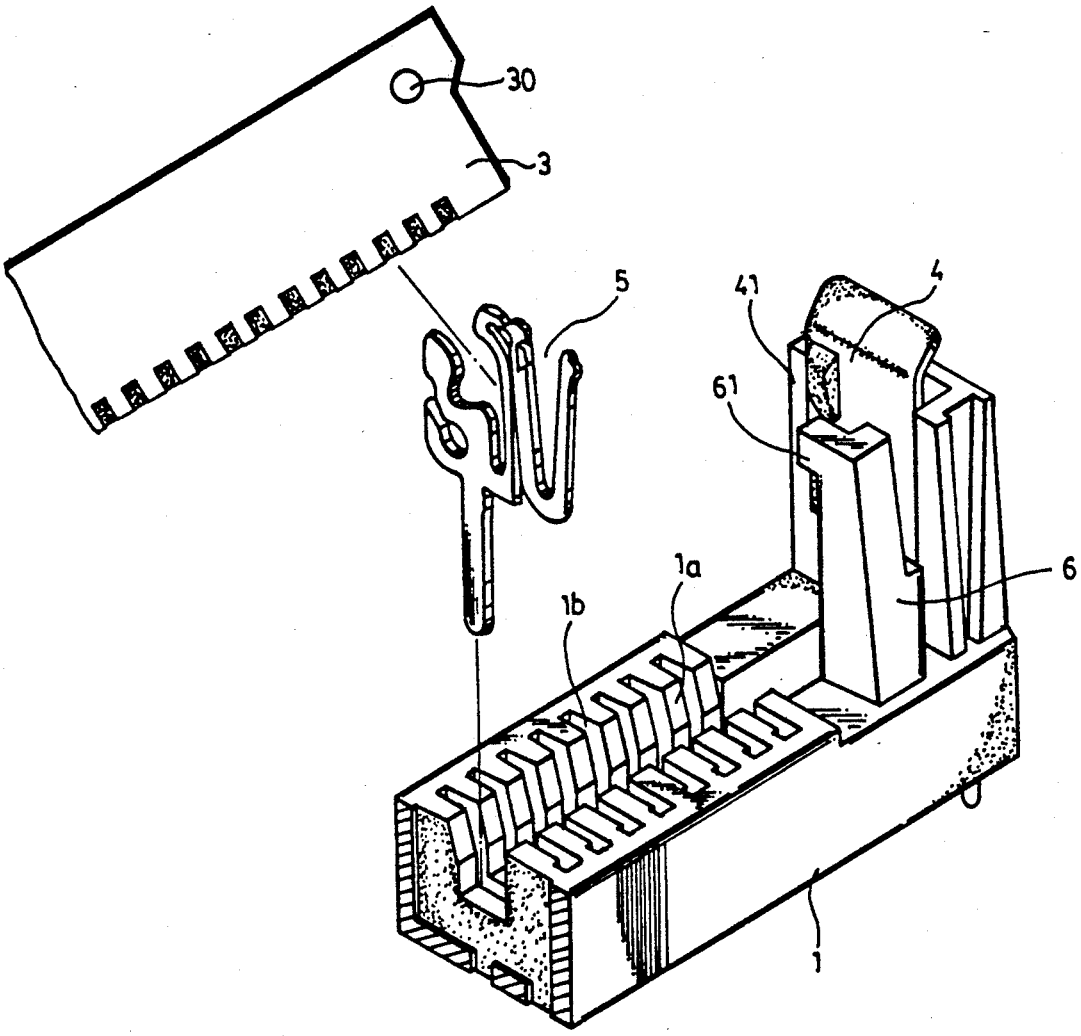
PRIOR ART FIG. 1
FIG. 1 is a perspective view showing a prior art circuit board connector socket.
Figure 2:
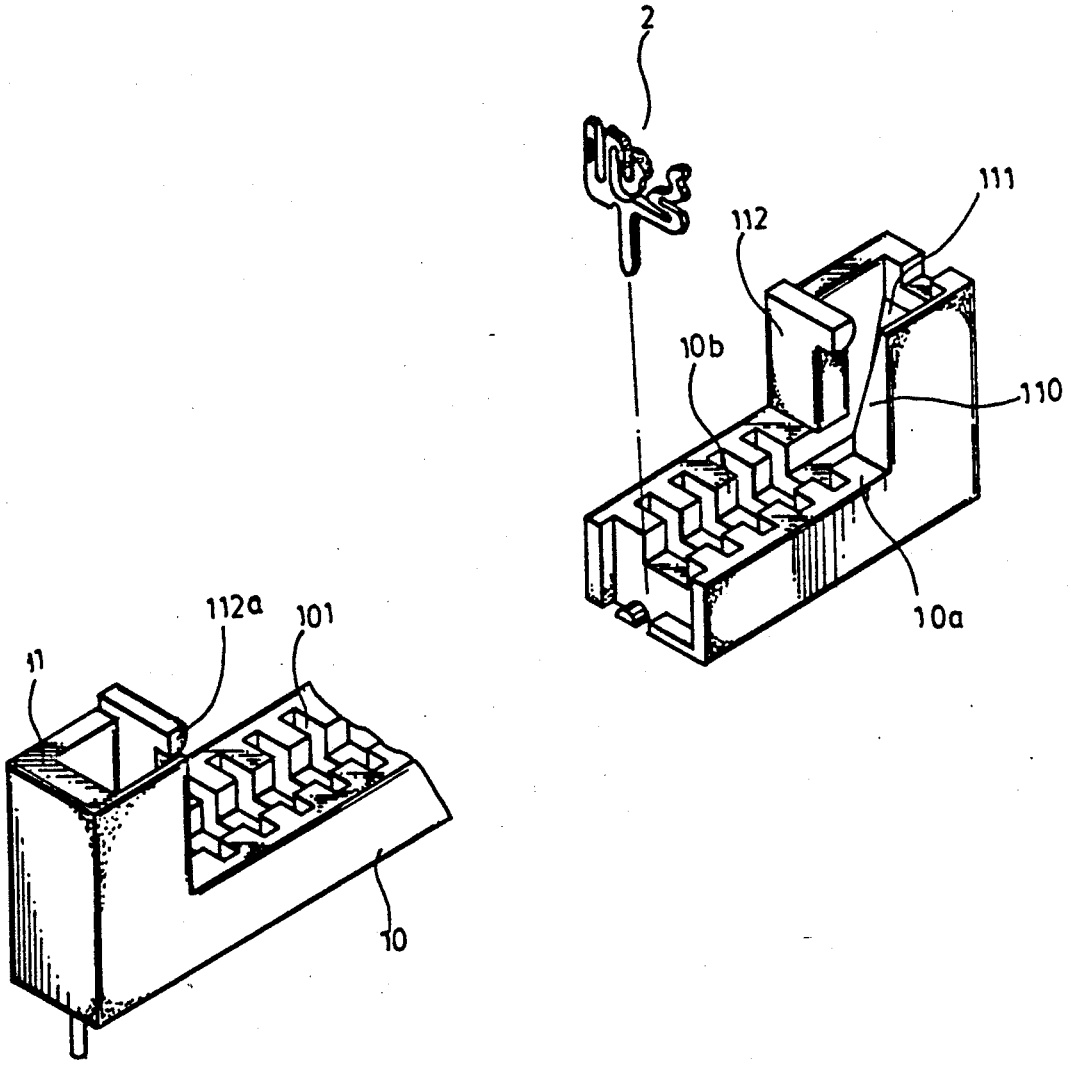
FIG. 2 is a perspective view showing a circuit board connector socket of the present invention.

Referring to FIG. 2 of the drawings, an edge connector socket of the present invention comprises an elongate housing 10 of an insulative synthetic material and a plurality of plate-like conductive contact members 2 carried therein. Housing 10 has a pair of vertical guide brackets 11 formed on respective end portions thereof and a recessed insertion face 10*a* extending between the end portions. An elongate channel 10*b* formed in the insertion face extends therealong for receiving an edge portion of a daughter board provided with contact terminals. Each contact member 2 is disposed parallel within a corresponding slot 101 formed along the insertion face at a perpendicular alignment with respect to the channel 10*b*.

Figure 6A:
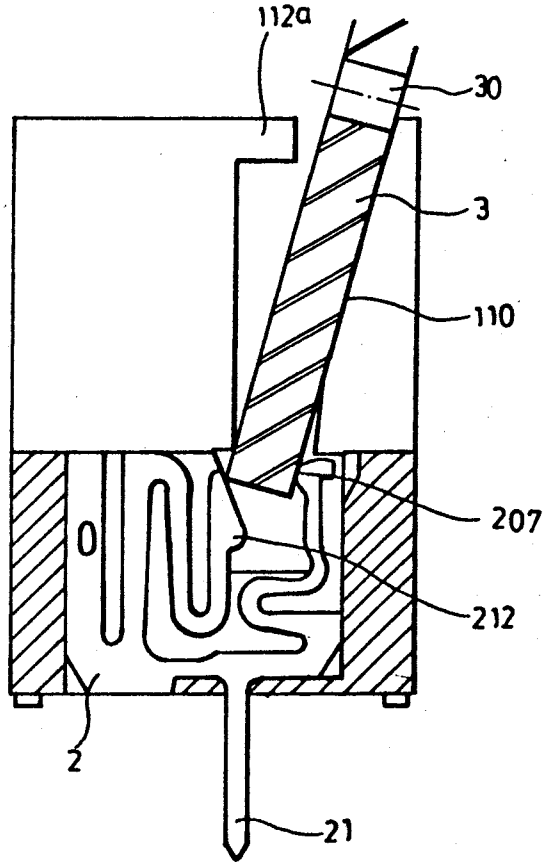
FIGS. 6*a* and 6*b* are a sectional view showing the insertion of a daughterboard into the socket mounting in a functional position therein.
Figure 6B:
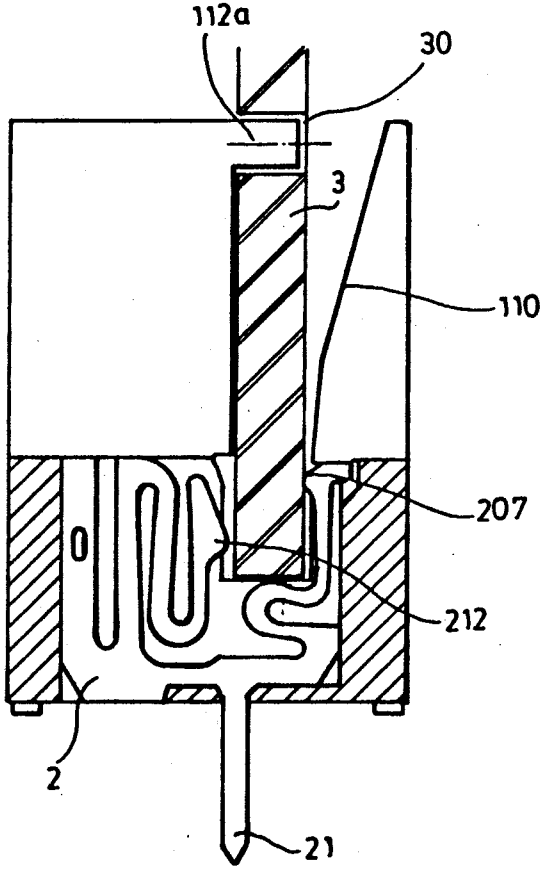

As shown in FIG. 6, a daughterboard 3 is mounted into a functional position within the connector by first inserting the connecting edge portion thereof into channel 10*b* of the insertion face at a predetermined acute angle therewith. Afterwhich, the resilient contact members 2 automatically rotate the board 3 which is engaged therewith into a vertical alignment with respect to the insertion face, as discussed more fully below.

Figure 4:
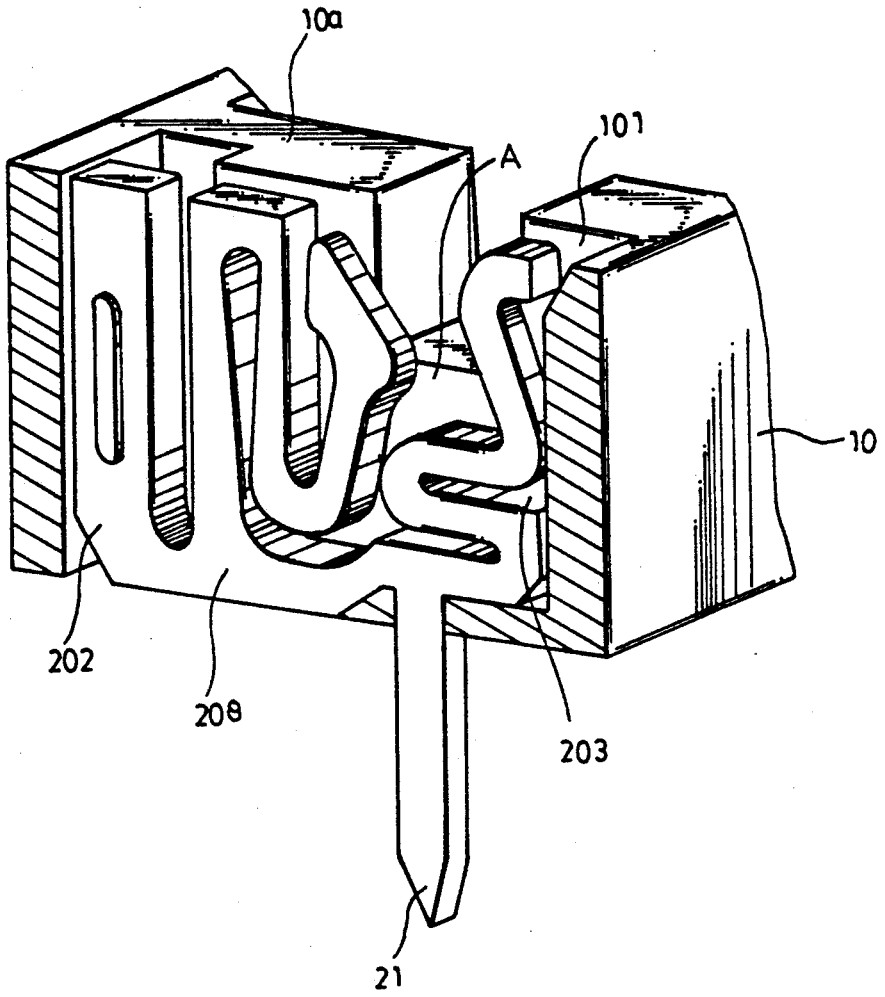
FIG. 4 is a perspective view of the contact member disposed within a slot of the socket's housing.
Figure 5:
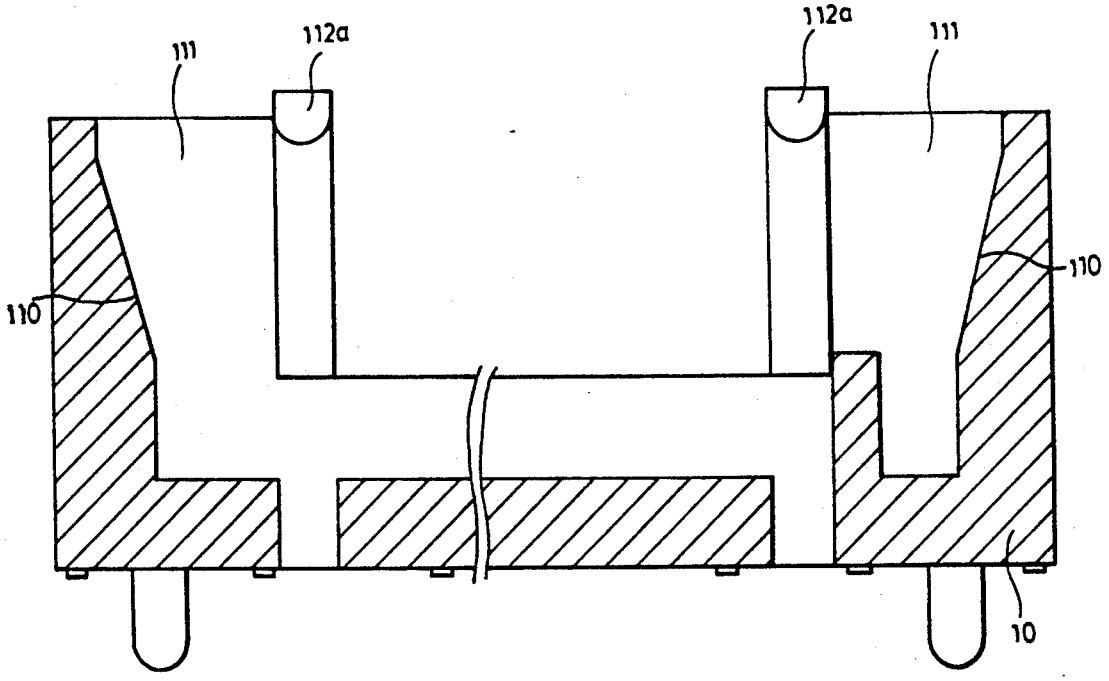
FIG. 5 is a sectional view of a guide bracket on an end portion of the housing.

As best seen in FIGS. 2 and 4, each guide bracket 11 has an inclined ramp 110 formed therein that is disposed to a first side of a vertical plane assumed by a daughterboard when in a functional position within channel 10*b*. Ramps 110 in either bracket act as guides for the insertion of a daughterboard into the housing at the proper angle. A lateral, inclined stop surface 111 is also defined on an inner wall of each bracket 11 adjacent a ramp 110 for facilitating the correct lateral alignment of a daughterboard with respect to the contact members within the housing during insertion. Each bracket 11 also has an adjoined, vertical securing post 112 disposed to a second side of the vertical plane assumed by a functionally positioned daughterboard. A protruding pin 112a on the upper end of each post is directed towards the first side of the vertical plane and engages a corresponding cooperating aperture 30, as shown in FIG. 6, on daughterboard 3 when the latter is so positioned, so as to secure the board on the connector.

Figure 3:
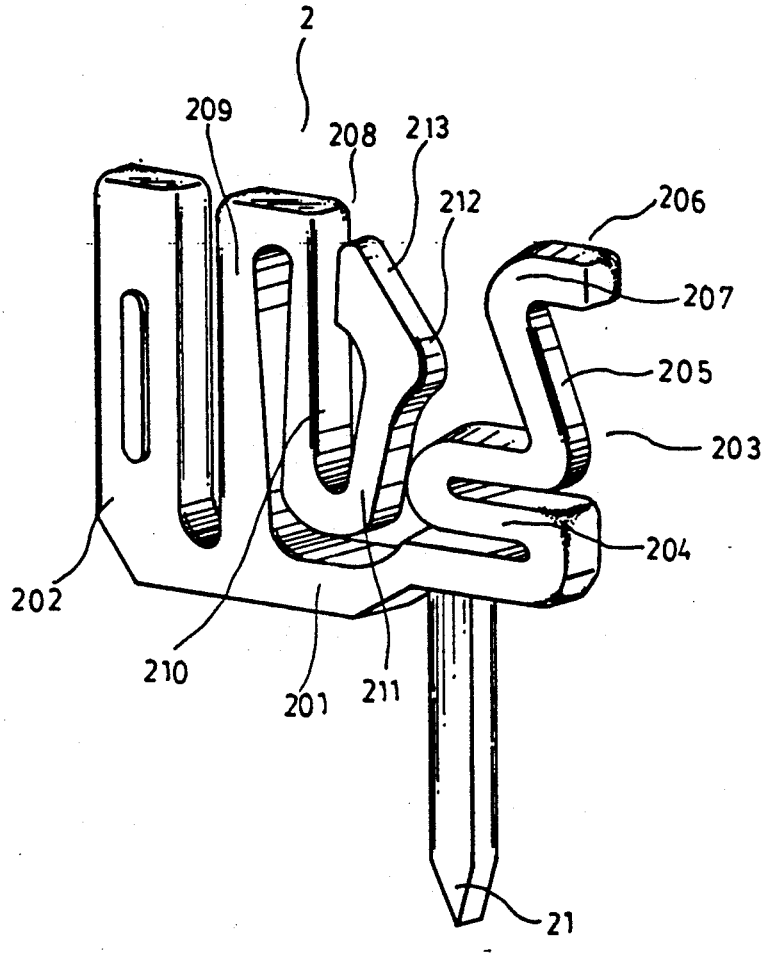
FIG. 3 is a perspective view of a contact member of the connector socket.

Referring to FIGS. 3 and 4, each contact member 2 includes a base 201 disposed in a lower portion of an associated slot 101, and a depending terminal pin 21 on a raised lower surface of the base adjacent a first lateral end thereof. A generally linear retaining member 202 extending vertically upward from a second lateral end of base 201 anchors the contact member within the slot 101. A crenelated fulcrum member 203 having a lower, roughly S-shaped section 204, an oblique section 205, and a level section 206 extends upward from the first lateral end of base 201, wherein section 204 has a medial transverse portion adjoined on an outer end to the base and a parallel upper transverse portion adjoined to the medial portion via an inner bight. A lower end of oblique section 205 adjoins with the outer end of the upper portion of section 204, while the level section 206 adjoins with upper end of the oblique section to define a rounded first apex 207 directed towards the retaining member 202. A crenelated spring member 208 extends upward from a medial position on the base between members 202,203. Member 208 has a linear ascending section 209 adjoined with the base and spaced from member 202, and a descending section 210 adjoined with the ascending section on the upper ends thereof. Further, an upwardly directed, inflected section 211 adjoined with section 210 via a lower bight defines a rounded, protruding second apex 212 on a medial position thereon, and an inclinate cam surface 213 extending from the terminal end of the inflected section to apex 212. The second apex is directed towards the fulcrum member spaced therefrom assumes a lower position relative to the first apex 207.

Referring again to FIG. 6, in operation a connecting edge of daughterboard 3 is inserted into a receiving space A defined between the spring and fulcrum members of contact members 2 with the aid of ramps 110 so as to engage a terminal edge of the daughterboard with the cam surfaces 213 on the spring members. The downward travel of the daughterboard then effects the flexure of the spring members 208 which subsequently exert a reaction force against a first side of the board via the aligned second apexes 212 in abutment therewith. Concomitantly, aligned first apexes 207 are in abutment with a second side of the board to define a pivot axis about which the reaction forces from the compressed spring members generate a torque that automatically rotates the board towards posts 112 upon release. Whereat, pins 112a engage corresponding apertures 30 to secure the daughterboard in a functional position on the socket. The contact member 2 are in electrical communication with corresponding terminals on the edge of the daughterboard which are connected with corresponding terminals on an underlying motherboard (not shown) via pins 21 that are soldered thereto.

It should be understood that the above disclosure and all specificities related to therein should not be construed as being limitative but rather as being exemplary, with the actual spirit and scope of the present invention being determined from the appended claims and their legal equivalents.

What is claimed is:

1. An edge connector socket for printed circuit boards comprising:

an elongate insulative housing having;

a) a first and second end portions, and an elongate insertion face extending therebetween, said insertion face having;

i) an elongate, recessed channel extending therealong for receiving an edge portion of a daughter board provided with conductive terminals;

ii) a plurality of parallel slots formed therealong in perpendicular alignment over the channel;

b) a vertical securing post on each end portion disposed to a first side of a substantially vertical plane passing through the channel that is assumed by a printed circuit board when mounted in a functional position in said socket, each said post having a protruding pin extending towards a second side of the plane for engagement with a corresponding cooperating aperture on a daughter board when in said functional position;

c) a guide ramp on each end portion disposed to the second side of the plane and inclined at a predetermined insertion angle therewith for guiding the insertion of a daughter board into the channel;

a plurality of conductive contact members, each said contact members being disposed in a corresponding slot in said housing and having;

a) a base disposed in a lower portion of an associated slot having a terminal pin depending therefrom for establishing an electrical communication with a motherboard below said housing;

b) a generally linear vertical member extending upward from said base at a first transverse end thereon;

c) a crenelated fulcrum member on a second transverse end of said base having;

i) a lower generally S-shaped section defining substantially parallel upper and medial transverse portions adjoined by an inner bight;

ii) an upper oblique section adjoined to an outer end of the upper transverse portion, inclined towards said vertical member;

iii) a level section adjoined to the upper end of the oblique section to define a rounded first apex, wherein said first apex of said contact members abut a first side of a daughter board inserted into the channel of said housing to define a fulcrum about which the daughter board is rotated into said functional position;

d) a crenelated spring member on a medial position on said base spaced from said fulcrum member to define a receiving space in communication with the opening of the channel, said spring member having;

i) an ascending section spaced from said vertical member extending upward from said base;

ii) a descending section adjoined to an upper end of the ascending section;

iii) an upwardly directed inflected section adjoined to a lower end of the descending section by a bight, said inflected section defining;

a rounded second apex at a medial position thereon, directed towards said fulcrum member and of a lower position relative to said first apex, for abutting a second side of a daughter board inserted into said receiving space;

an inclinate cam surface on a terminal edge portion thereon leading to said second apex, for engaging a terminal edge of a daughter board inserted into said receiving space;

whereby, insertion of a daughter board into said receiving space of said contact members effects a flexure of said spring member thereof, reaction forces from said spring member of said contact members applied via said second apex thereof generate a torque on the daughter board to rotate the daughter board into engagement with said pin on each said securing post, mounting the daughter board in a functional position in said socket.

2. An edge connector socket according to claim 1, wherein each said insertion guide is inclined at a 10 to 15 degree angle with respect to said plane passing through the channel of said housing.

3. An edge connector according to claim 2, further including a pair of lateral stop surfaces on respective said end portions of said housing for engaging corresponding lateral edge portions of a daughter board during insertion into said housing so as to ensure a proper registry between the daughter board and said housing.

* * * * *